United States Patent [19]

Wada

[11] 4,435,065

[45] Mar. 6, 1984

[54] ELECTROGRAPHIC DEVELOPING APPARATUS WITH TONER FLOW DIRECTOR

[75] Inventor: Kenichi Wada, Osaka, Japan

[73] Assignee: Minolta Camera Kabushiki Kaisha, Osaka, Japan

[21] Appl. No.: 356,646

[22] Filed: Mar. 10, 1982

[30] Foreign Application Priority Data

Mar. 31, 1981 [JP] Japan ..... 56-48683

[51] Int. Cl.³ ..... G03G 15/08; G03G 15/09

[52] U.S. Cl. ..... 355/3 DD; 355/14 D; 118/653; 118/658

[58] Field of Search ..... 355/3 DD, 14 D, 3 R, 355/14 R; 118/652, 653, 656, 658, 640

[56] References Cited

U.S. PATENT DOCUMENTS 3,013,703 12/1961 Hunt ..... 222/409

3,623,503 11/1970 Suzuki et al. ..... 137/454

4,181,422 1/1980 Forgo et al. ..... 355/3 DD 4,240,375 12/1980 Terashima ..... 355/3 DD X 4,321,886 3/1982 Azuma ..... 355/3 DD X 4,342,283 8/1982 Terashima ..... 355/3 DD X

*Primary Examiner*—A. C. Prescott

*Attorney, Agent, or Firm*—Wenderoth, Lind & Ponack

[57] ABSTRACT

An electrographic developing apparatus having incorporated therein a toner supply device by which the toner concentration of the developer accommodated in a developer container can be maintained at a constant value substantially without requiring any toner concentration detector. The device has a toner tank having a bottom adapted to be contacted by the developer contained in a toner supply section of the container, and a developer moving device for forcibly moving a portion of the developer contained in a developing section of the container into the toner supply section when replenishing toner is dispensed from the tank.

8 Claims, 6 Drawing Figures

ELECTROGRAPHIC DEVELOPING APPARATUS WITH TONER FLOW DIRECTOR

The present invention relates to an electrographic developing apparatus, and more particularly to an apparatus for developing latent electrostatic images with a powder developer in the form of a mixture of a carrier and a toner.

BACKGROUND OF THE INVENTION AND PRIOR ART

In an electrographic developing apparatus of this type, the toner contained in the developer in a developer container is consumed by the development of latent electrostatic images, so that there is a need to replenish the developer in the container with toner to compensate for the gradual decrease of the amount of toner and keep the proportion of toner, i.e. the toner concentration, uniform at all times.

Accordingly various toner supply devices have been proposed. Such devices include one which is adapted to directly detect the toner concentration of the developer accommodated in the developer container and replenish the developer with a suitable amount of toner in accordance with the detected value. Another proposed device utilizes the fact that the decrease in the overall amount of developer in the developer container is approximately in proportion to the reduction in the toner concentration of the developer, and it is adapted to detect the amount of developer in the container and to replenish the developer with a suitable amount of toner in accordance with the detected value.

Such toner supply devices, when used in an electrographic developing apparatus, make it possible to automatically replenish the developer in the developer container with toner, but the devices require a complex detecting circuit or the like and further involve many problems in reliably maintaining the toner concentration of the developer at a constant level at all times. Thus the devices should be improved still further before they can be put to practical use in an electrographic developing apparatus.

OBJECTS AND SUMMARY OF THE INVENTION

The main object of the invention is to provide a useful toner supply device for an electrographic developing apparatus.

Another object of the invention is to provide an electrographic developing apparatus having incorporated therein a toner supply device which has a simple construction and which requires only a simple detecting circuit, unlike conventional devices.

Still another object of the invention is to provide an electrographic developing apparatus including a toner supply device by which the toner concentration of the developer in a developer container can be maintained at a constant level with a high reliability at all times.

The above and other objects of the invention can be fulfilled by an electrographic developing apparatus according to the invention and comprising a developer container generally divided into a toner supply section and a developing section and adapted to contain a powder developer in the form of a mixture of a carrier and a toner, means for developing latent electrostatic images on an image bearing member with the developer contained in the developing section of the container, a toner tank adapted to contain a supply of toner therein and having a bottom capable of contacting the developer contained in the toner supply section of the container, a toner passing aperture in the bottom of the toner tank, a movable member for opening and closing the toner passing aperture, means for moving the movable member to open the toner passing aperture when toner is to be supplied and for holding the movable member in an aperture closing position when no toner is to be supplied, and means for forcibly moving a portion of the developer from the developing section of the container into the toner supply section at least when the toner is to be supplied.

The movable member comprises a reciprocating plate slidably provided beneath the bottom of the toner tank and having an opening which can be placed in register with the toner passing aperture. The reciprocating plate moves in a direction from the developing section of the container toward the toner supply section thereof and also in the direction opposite thereto. The developer moving means comprises a downwardly bent portion of the reciprocating plate at the end thereof closer to the developing section. Alternatively the developer moving means comprises a pair of spiral rollers provided in the lower part of the interior of the developer container, or a rotary blade provided at the boundary between the developing section and the toner supply section. At least when the toner is supplied, the developer moving means raises the top level of the developer contained in the supply section of the container relative to the top level of the developer accommodated in the developing section.

The electrographic developing apparatus is provided with regulator means for regulating the amount of toner to be dispensed from the toner tank to replenish the developer in the container when the toner passing aperture is opened by the movement of the movable member.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE INVENTION

Figure 1:
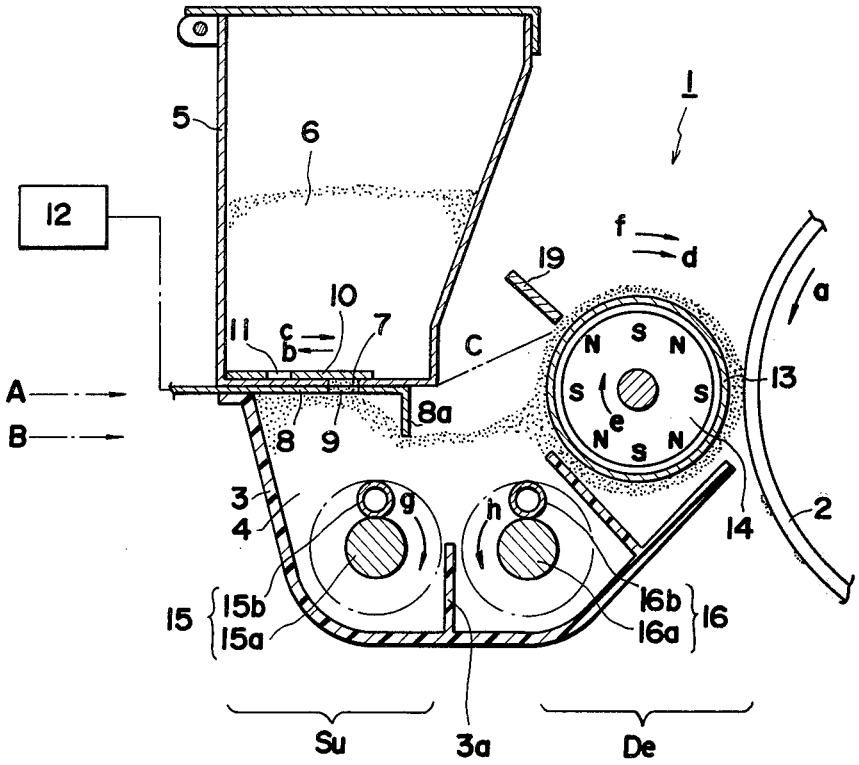
FIG. 1 is a diagram showing the internal construction of an electrographic developing apparatus embodying the invention.

An electrographic developing apparatus embodying the invention will be described hereinafter as being incorporated in an electrophotographic copying machine of the toner image transfer type.

The developing apparatus 1 is opposed to the surface of an electrophotographic photoconductive drum 2 which is rotatingly driven in the direction of arrow a while carrying on the surface a latent electrostatic image formed by unillustrated means. The apparatus 1 develops the latent image to a visible image with a powder developer 4 which is accommodated in a developer container 3 and which is in the form of a mixture of a carrier and a toner. More specifically the developer 4 comprises a magnetic carrier in the form of small particles and having a high resistivity, e.g. a 21 μm mean particle size and a magnetic material having at least $10^{13}$ ohm-cm resistivity, and an insulating toner, e.g. a nonmagnetic material having a mean particle size of 11 μm and admixed with the carrier.

The developer container 3 is divided generally into two sections, i.e. a toner supply section Su and a developing section De. Strictly speaking, the term "toner supply section Su" refers to the section of the container 3 which is directly opposed to the toner passing aperture 7 to be described later. A toner tank 5 is disposed above the toner supply section Su. The toner tank 5 contains a supply 6 of toner for replenishing the developer 4 accommodated in the container 3, i.e. replenishing the insulating toner which has been taken out of the developer 4 and consumed in forming the developed images. The replenishing toner supply 6 may contain a small amount of magnetic carrier which has been added thereto. While a small quantity of developer 4 is likely to escape from the container 3 to thereby decrease the absolute amount of carrier within the container 3, the decrease can be compensated for by the addition of carrier. The toner tank 5 has a bottom portion adapted to be contacted by the top of the portion of developer 4 accommodated in the supply section Su. The length of the bottom portion perpendicular to the plane of FIG. 1, i.e. parallel to the axis of the drum 2, is slightly less than but almost equal to the corresponding length of the developer container 3. The bottom has the toner passing aperture 7 therein which, although not visible in the drawing, is in the form of a slit extending longitudinally for approximately the entire length of the botttom of the tank 5. The aperture 7 has a size for permitting the replenishing toner 6 to fall through the aperture under the effect of gravity.

Figure 2:
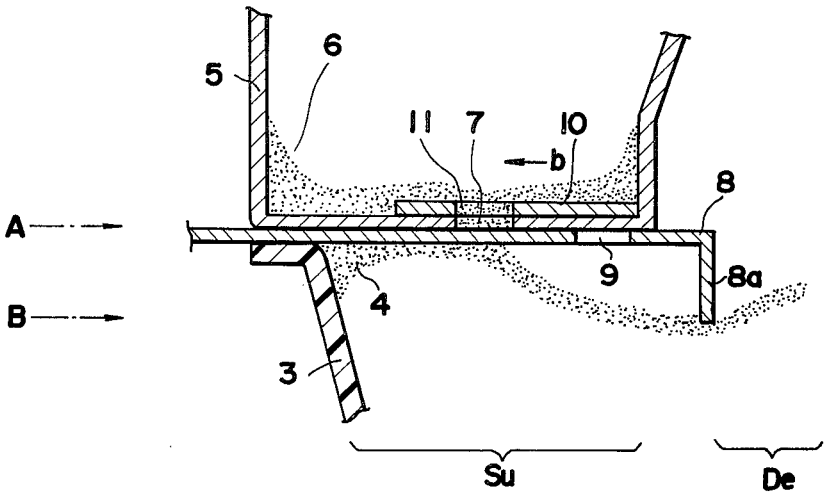
FIGS. 2 to 4 are fragmentary views showing the apparatus, FIG. 2 showing the apparatus when no toner is being supplied, and FIGS. 3 and 4 showing the apparatus when toner is being supplied.

The toner passing aperture 7 is opened and closed by a movable member which in the present embodiment is a reciprocating plate 8. The reciprocating plate 8 is provided beneath the aperture 7 outside the bottom of the toner tank 5. It is so supported as to be slidable beneath the bottom in the directions of arrows b and c. The reciprocating plate 8 has an opening 9 therein for uncovering the aperture 7. The opening 9 is identical in shape and size with the toner aperture 7. When the reciprocating plate 8 is in the aperture closing position as shown in FIG. 2, the opening 9 is out of register with the toner aperture 7, and only when the plate 8 is moved in the direction of arrow b to an aperture opening position (i.e. the position shown in FIG. 4), is the opening 9 in register with the toner aperture 7 to substantially uncover the aperture 7. Accordingly the reciprocating plate 8, while in the closing position, keeps the aperture 7 closed, preventing the toner 6 in the tank 5 from falling, whereas when the plate 8 is in the opening position, the aperture 7 is substantially open, permitting a portion of the toner 6 to fall from the tank 5 through the aperture 7. The reciprocating plate 8 is usually held in the position shown in FIG. 2.

A regulator plate 10 for regulating the amount of toner supplied during toner replenishment is provided inside the bottom of the toner tank 5 above the aperture 7. The regulator plate 10 has an opening 11 identical in shape and size with the aperture 7 and is slidable on the inner surface of the bottom in the directions of arrows b and c. Plate reciprocating means 12 including an eccentric cam or the like is provided for moving the plate 8, and can be connected directly to the regulator plate 10, or the plate 10 can be connected with the reciprocating plate 8 so as to be moved in these directions with the plate 8. The opening 11 in plate 10 is out of register with opening 9 in plate 8, so that when the reciprocating plate 8 is in the aperture closing position shown in FIG. 2, the opening 11 is in register with the aperture 7, permitting an amount of toner from the supply 6 in the tank 5 to enter the aperture 7. However, when the plate 8 is in the aperture opening position shown in FIG. 4, the regulating plate 10 prevents the toner from supply 6 from entering the aperture 7. Consequently the maximum amount of replenishing toner that can be supplied through the aperture 7 to the developer 4 in the container 3 at any one time when the toner passing aperture 7 is open is restricted to the quantity corresponding to the volume of the aperture 7. In the present embodiment, the moving means 12 is adapted to move the reciprocating plate 8 and the regulator plate 10 through one reciprocation in the directions of arrows b and c for every copying cycle. The volume of the aperture 7 is set at a value approximately corresponding to the largest amount of toner consumed in developing a latent electrostatic image while making one copy. More specifically the aperture 7 is adapted to contain 200 mg of replenishing toner from the supply 6. However, the aperture 7 may be made with a size sufficient to contain 30 to 500 mg, preferably 50 to 200 mg, of toner.

The edge of the reciprocating plate 8 closer to the developing section De is bent in an L-shape in cross-section to provide a bent portion 8*a*, which plays an especially important role when a replenishment toner is dispensed. The outer bottom surface of the toner tank 5 is at the level A, while the lower edge of the bent portion 8*a* of the reciprocating plate 8 is located at the level B. During the reciprocation of the plate 8, a portion of the developer 4 accommodated in the developing section De of the container 3 is forcibly moved into the toner supply section Su by the bent portion 8*a*. Thus during the replenishment, the level of the top surface of the developer accommodated in the supply section Su of the container 3 is raised relative to the level of the top surface of the developer accommodated in the developing section De. To clarify this, the operation of the present embodiment for replenishing the toner will be described with reference to FIGS. 2 to 4.

When no replenishing toner is supplied, the reciprocating plate 8 and the regulator plate 10 are held stationary in the positions shown in FIG. 2. Accordingly the toner passing aperture 7 is closed by the reciprocating plate 8, and no replenishing toner is supplied from the toner tank 5 to the developer 4 in the container 3. However, since the aperture 7 is in register with the opening 11 in the regulator plate 10, the replenishing toner from the supply 6 in the tank 6 fills the aperture 7. At this time, there is a space below the bottom of the toner tank 5, or more accurately stated, between the lower surface of the reciprocating plate 8 and the top of the developer 4 contained in the toner supply section Su of the container 3.

Figure 3:
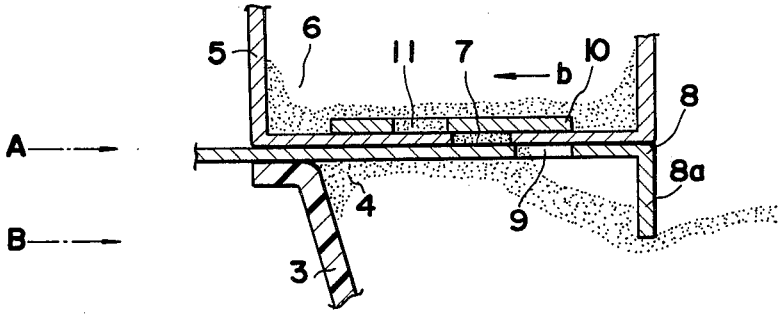

When an amount of toner is to be dispensed for replenishment, the movement of the reciprocating plate 8 and the regulator plate 10 in the direction of arrow b is started and the plates 8 and 10 are shifted to the position shown in FIG. 3. With this movement, the developer 4 accommodated in the developing section De of the container 3 is partly forcibly moved into the toner supply portion Su by the action of the bent portion 8*a* of the reciprocating plate 8 so as to gradually fill the space therein. Simultaneously with this, the level of the top of the portion of the developer 4 accommodated in the developing section De and located close to the supply section Su is lowered to the level B shown at the left in FIGS. 2–4. To offset the lowered level, part of another portion of the developer 4 in the developing section De which lies above the level B moves toward the supply section Su. Consequently the level of the top of the developer 4 accommodated in the developing section De is generally lowered. On the other hand, the level of the top of the portion of developer 4 accommodated in the supply section Su rises due to the presence of the developer portion forcibly moved from the section De into the section Su. However, the level will not exceed the level A.

Figure 4:
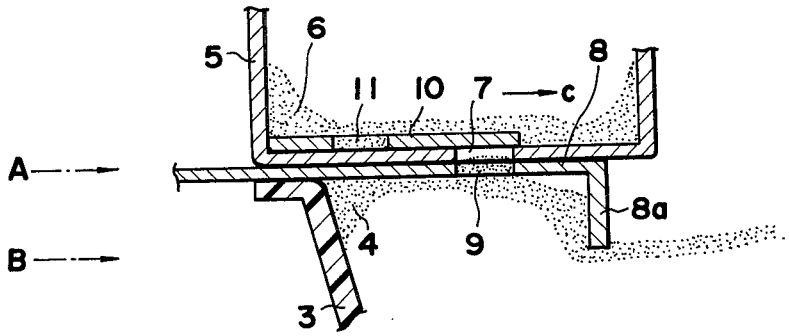

For replenishment, the plate 8 and the regulator plate 10 are moved further in the direction of arrow b and eventually brought to the position shown in FIG. 4 where the opening 9 of the plate 8 is in register with the toner passing aperture 7. With the aperture 7 thus opened, the replenishing toner therein is allowed to fall through the opening 9 into the container 3. Since no replenishing toner from the supply 6 is permitted to enter the aperture 7 due to the presence of the regulator plate 10, the amount of toner 6 that can fall into the container 3 is regulated to a specified quantity.

According to the present embodiment, the levels A and B, the amount of movement of the reciprocating plate 8, etc. are set so that if the proportion of toner contained in the developer 4, i.e. the concentration of toner, in the container 3 is correct, and the absolute amount of toner in the developer is correct, the developer 4 moved into the section Su by bent portion 8*a* raises the level of the top of the developer so as to block the opening 9 at the level A. In such a case, therefore, the replenishing toner in the aperture 7 will not fall out of aperture 7, and no toner is supplied to the developer 4 in the container 3. The plates 8 and 10 are then returned in the direction of arrow c to the positions shown in FIG. 2.

However, when the proportion or concentration of the toner in the developer 4 in the container 3 is reduced due to the development of latent electrostatic images so that the absolute amount of toner present is reduced, the level of the top of developer 4 in the supply section Su will not reach the level A, and a space corresponding to the amount of toner consumed in such development will be left within the container 3 below the level A. Consequently a suitable amount of toner falls into the container 3 to fill this space, whereby the toner in the developer 4 is replenished. The reciprocating plate 8 and the regulator plate 10 are then moved in the direction of arrow c and returned to the positions shown in FIG. 2. At this time, any toner which has not fallen from the aperture 7 because of lack of space in container 3 is carried along with plate 8, so that the quantity of toner entering the aperture 7 from supply 6 upon the return of the plates to the position of FIG. 2 is equal to the amount of toner used in replenishing the developer.

The above-described space will now be described in greater detail. The space is created by a reduction in the amount of developer 4 due to a decrease in the proportion or concentration of the toner in the developer. The amount of developer 4 is reduced corresponding to the amount of toner consumed in developing latent electrostatic images. The amount of toner falling into the container 3 to fill the space is exactly equal to the amount of toner consumed. Consequently the proportion or concentration of the toner in the developer 4 in the container 3 is maintained accurately at a constant value by the replenishment operation. If the proportion or concentration of the toner in the developer 4 in the container 3 remains unaltered, a space will not be formed since no reduction occurs in the amount of developer 4.

The amount of toner dispensed from the supply 6 for replenishing the toner taken out of the developer 4 is variable longitudinally of the slit-like aperture 7 along the length of the bottom of the toner tank 5, i.e. along the axis of the drum 2, so that when the proportion or concentration of the toner in the developer 4 varies lengthwise of the container 3, such variations can be corrected immediately by replenishing the toner from the supply 6 in the above manner. More specifically the amount of toner passed through the aperture 7 into the container 3 at a particular location is dependent solely on the level of the top of the developer 4 present immediately below the aperture 7 at that location. As a result, the replenishing toner can be supplied to the developer 4 in amounts varying longitudinally of the container 3, whereby the variations in toner concentration are readily eliminated.

The other components of the present embodiment will be described hereinafter.

Above the developing section De of the container 3 is a developing sleeve 13 positioned in proximity to the photoconductive drum 2 for developing the latent electrostatic image on the drum surface with the developer 4 accommodated in the section De of the container 3. The sleeve 13 is coupled to unillustrated drive means and rotated at 200 r.p.m. in the direction of arrow d. A magnetic roller 14 rotatably provided within the sleeve 13 is also rotated by the unillustrated drive means at 1300 r.p.m. in the direction of arrow e.

Since the sleeve 13 and the roller 14 are rotatingly driven in the same direction, the developer 4 is subjected to forces which act to convey the developer in opposite directions along the periphery of the sleeve 13, but because of the speeds described above, the resultant movement of the developer 4 is in the direction of arrow f. While the sleeve 13 and the roller 14 can be driven at speeds of rotation other than those described above if desired, it is preferred to rotate the sleeve 13 at 50 to 300 r.p.m. if the roller 14 is rotated at about 1300 r.p.m. In opposed relation to the peripheral surface of the developing sleeve 13, there is provided a plate 19 for regulating the amount of developer 4 transported along the surface of the sleeve 13.

Although not included in the present embodiment, a member may be provided by which the developer 4 used for developing the latent image while being transported along the surface of the sleeve 13 in the direction of arrow f is scraped off the sleeve surface and returned to the container 3. The member, namely a developer scraping blade, may be disposed in bearing contact with the surface of the sleeve 13 on the side thereof opposite to the side which is opposed to the drum 2.

Figure 5:
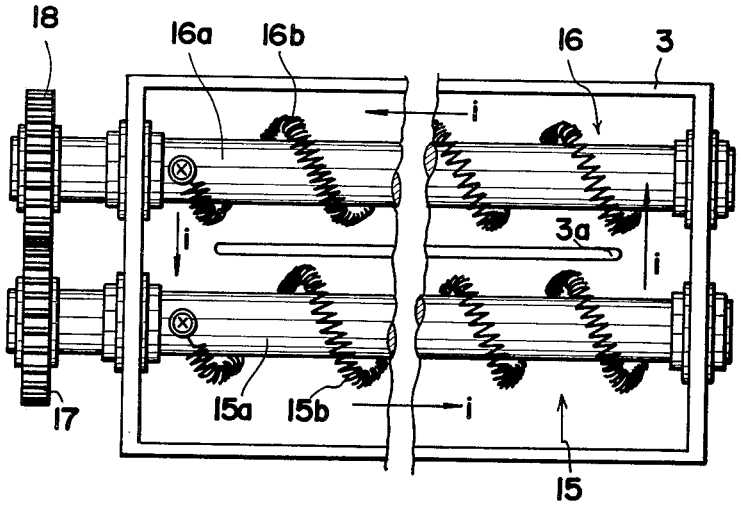
FIG. 5 is a plan view of the internal construction of the developer container included in the embodiment.

A pair of identically shaped spiral rollers 15 and 16 is provided in the bottom of container 3 entirely within the mass of developer 4. The spiral rollers 15 and 16 are driven in the directions of arrows g and h respectively to agitate the developer 4, whereby the carrier is triboelectrically charged negatively and the toner is charged positively. The spiral rollers 15 and 16 respectively comprise shafts 15*a* and 16*a* and individual coil springs 15*b* and 16*b* wound around the shafts in the same direction, and the shafts are operatively connected together by gears 17 and 18 and are driven in the directions of arrows g and h at equal speeds at all times by an unillustrated drive source (see FIG. 5). The partition 3*a* in the container 3 is positioned between the rollers 15 and 16. As seen in FIG. 5, the length of the partition 3*a* is much less than that of the rollers, so that the rollers 15 and 16 are not separated by the partition 3*a* at their opposite ends. Accordingly the developer 4 contained in the container 3 is circulated by the rotation of the rollers 15 and 16 as indicated by arrows i in FIG. 5.

To test the electrographic developing apparatus of the invention for advantages, an experiment was conducted in which latent electrostatic images of negative polarity were developed to make 10,000 copies on A4 size paper by the use of the embodiment of FIG. 1. For this experiment, 350 g of developer 4 containing 10 wt.% of toner was initially charged into the container 3. The levels A and B and the amount of movement of the reciprocating plate 8 were so adjusted that the total amount of developer 4 in the container 3 would be maintained at 350 g. The plate 8 was reciprocated one stroke every time a latent image was developed to reproduce a copy.

In order to alter the amount of toner consumed during development, the latent images to be developed were changed variously, e.g. from an image including solid areas to a line image and vice versa, but the latent images were developed satisfactorily at all times throughout the entire period of the experiment. Thus the experiment has revealed that hardly any variations occur in the toner concentration during the time when the developing apparatus of the invention is used.

When a similar developing experiment was carried out by use of the apparatus 1 like that shown in FIG. 1 except that the bent portion 8*a* was removed from the reciprocating plate 8, the top level of the developer 4 in the section De of the container 3 rose to a level indicated at C in FIG. 1 which caused an undesirable increase in the absolute amount of developer 4 in the container and various other objectionable conditions. Typical of such objectionable conditions were the fall of developer 4 from the space between the drum 2 and the developing sleeve 13, marked fogging of developed images, etc. It was of course impossible to keep the toner proportion of the developer 4 constant; the toner proportion or concentration increased greatly within a short period of time. It appeared that the increased concentration resulted directly from the rise of the level of the developer 4 and the fall or escape of the developer.

Another embodiment of the invention will be described hereinafter with reference to FIG. 6.

Figure 6:
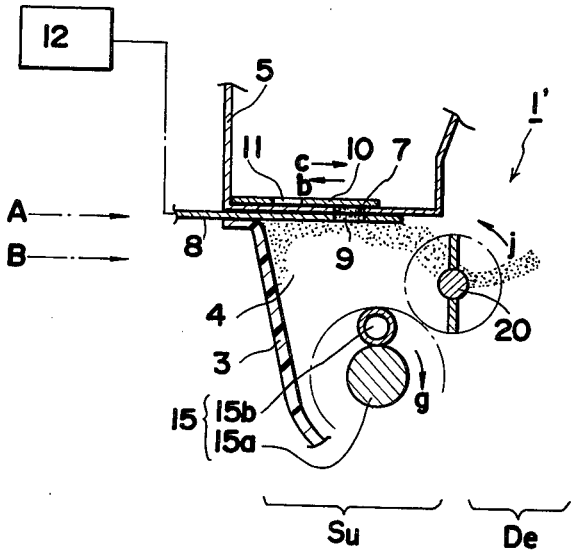
FIG. 6 is a fragmentary view showing the internal construction of another embodiment of the apparatus.

In the electrographic developing apparatus 1' shown in FIG. 6 the reciprocating plate 8 has no bent portion. Instead the apparatus includes a rotary blade 20. The rotary blade 20 is rotated in the direction of arrow j in timed relation with the reciprocation of the plate 8 and serves the same function as the bent portion 8*a* of the plate 8 in the above described embodiment when replenishing toner is dispensed.

The electrographic developing apparatus of this invention includes developer moving means, i.e. means for forcibly moving a portion of the developer in the developer section of the developer container into the toner supply section at least when toner is being supplied. While the bent portion 8*a* of the reciprocating plate 8 in the embodiment of FIGS. 1-5 or the rotary blade 20 in the embodiment of FIG. 6 serves as this means according to the present invention, other means can be used as the developer moving means. For example, if the spiral roller 16 is driven at a higher speed than the spiral roller 15 it will transport a greater amount of developer than the roller 15, so that the developer 4 contained in the developing section De of the container 4 can be moved substantially toward the toner supply section Su when replenishing toner is dispensed. Thus the spiral rollers 15 and 16 can be used as the developer moving means.

Although the present invention has been fully described by way of examples with reference to the accompanying drawings, it is to be noted that various changes and modifications will be apparent to those skilled in the art. Therefore, unless otherwise such changes and modifications depart from the scope of the invention, they should be construed as being included therein.

What is claimed is:

1. An electrographic developing apparatus which comprises:

a developer container having means dividing it into a toner supply section and a developing section and adapted to be normally substantially filled with a powder developer in the form of a mixture of a carrier and a toner;

means adjacent the developing section for developing latent electrostatic images on an image bearing member by the use of the developer contained in the developing section of the container;

a toner tank above said toner supply section and adapted to contain a supply of toner therein and having a bottom adapted to be contacted by the developer contained in the toner supply section of the container, said bottom having a toner passing aperture therein;

a movable member movable along said bottom for opening and closing the toner passing aperture;

means connected to said movable member for moving said movable member to open the toner passing aperture when toner is to be supplied and for holding the movable member in an aperture closing position when no toner is to be supplied; and developer moving means for, when the level of said developer is sufficiently high, physically contacting and forcibly moving a portion of the developer from the developing section of the container into the toner supply section during a time at least when said movable member is moved to the position where the toner passing aperture is open and the toner is being supplied for raising the level of the top of the developer contained in the supply section of the container relative to the level of the top of the developer in the developing section.

2. An electrographic developing apparatus as claimed in claim 1, wherein said movable member comprises a reciprocating plate slidably mounted beneath the bottom of the toner tank and having an opening which is movable into and out of register with the toner passing aperture when said plate is reciprocated.

3. An electrographic developing apparatus as claimed in claim 2, wherein said reciprocating plate is movable in a direction between the developing section of the container and the toner supply section thereof.

4. An electrographic developing apparatus as claimed in claim 3, wherein the developer moving means comprises a downwardly bent portion on the end of the reciprocating plate toward the developing section.

5. An electrographic developing apparatus as claimed in claim 1, wherein the developer moving means comprises a pair of spiral rollers in the lower portion of the interior of said developer container.

6. An electrographic developing apparatus as claimed in claim 1, wherein the developer moving means comprises a rotary blade at the boundary between the developing section and the toner supply section.

7. An electrographic developing apparatus as claimed in claim 1, further comprising regulator means for regulating the amount of toner dispensed from the toner tank to replenish the developer in the container when the toner passing aperture is opened during the movement of the movable member.

8. An electrophotographic developing apparatus as claimed in claim 7 in which said regulator means comprises a regulator plate having a regulating aperture therein and movable along said toner tank bottom within said toner tank for placing said regulating aperture therein in alignment with said toner passing aperture when said movable member is in a position for closing said toner passing aperture.

* * * * *